US008723009B2

(12) United States Patent
Sullivan et al.

(10) Patent No.: US 8,723,009 B2
(45) Date of Patent: May 13, 2014

(54) DRUMSTICK MOUNTED MUTABLE TAMBOURINE

(75) Inventors: Patrick Timothy Sullivan, Downy, CA (US); James Edward Brisco, La Habra, CA (US); Thomas Patrick Davis, Ontario, CA (US)

(73) Assignee: Patrick T. Sullivan, St. Downey, CA (US)

( * ) Notice: Subject to any disclaimer, the term of this patent is extended or adjusted under 35 U.S.C. 154(b) by 73 days.

(21) Appl. No.: 13/418,571

(22) Filed: Mar. 13, 2012

(65) Prior Publication Data

US 2013/0239777 A1 Sep. 19, 2013

(51) Int. Cl.
*G10D 13/02* (2006.01)

(52) U.S. Cl.
USPC ..... 84/422.4

(58) Field of Classification Search
USPC ..... 84/422.4
See application file for complete search history.

(56) References Cited

U.S. PATENT DOCUMENTS

| | | | | |
|---|---|---|---|---|
| 1,333,565 | A | 3/1920 | Newlin | |
| 1,953,619 | A * | 4/1934 | Ludwig | 84/422.4 |
| 2,466,554 | A | 4/1949 | Harry | |
| 2,678,517 | A | 5/1954 | Dean | |
| D220,002 | S | 2/1971 | Barker | |
| 3,592,097 | A * | 7/1971 | Friede | 84/402 |
| 4,244,267 | A | 1/1981 | Nemeth | |
| 4,269,105 | A | 5/1981 | Salmon | |
| 4,688,462 | A | 8/1987 | Greenspoon | |
| 4,858,510 | A | 8/1989 | Shimoda et al. | |
| 5,044,250 | A | 9/1991 | Beyer | |
| 5,265,514 | A | 11/1993 | Schertz | |
| 5,355,760 | A | 10/1994 | Bein et al. | |
| 6,127,614 | A | 10/2000 | Lombardi | |
| 6,316,709 | B1 * | 11/2001 | Nanberg et al. | 84/422.4 |
| 6,365,813 | B1 * | 4/2002 | Gress | 84/422.4 |
| 6,423,890 | B2 * | 7/2002 | Zbrzezny et al. | 84/422.4 |
| 7,176,369 | B1 * | 2/2007 | Brooks | 84/422.4 |
| 7,595,442 | B2 * | 9/2009 | Grover | 84/422.4 |
| 8,058,541 | B2 * | 11/2011 | Taninbaum | 84/422.4 |
| 2009/0178538 | A1 | 7/2009 | Van Der | |
| 2010/0058919 | A1 | 3/2010 | Rice | |
| 2013/0239777 | A1 * | 9/2013 | Sullivan et al. | 84/422.4 |

* cited by examiner

*Primary Examiner* — Robert W Horn
(74) *Attorney, Agent, or Firm* — Self Legal Zoom

(57) ABSTRACT

A drumstick mountable mutable tambourine comprises a body mountable to the drumstick. A block may be attached to the body on which one or more mutable sound making devices are mountable. A muting device may be capable of actuation for muting the mutable sound making devices.

16 Claims, 2 Drawing Sheets

DRUMSTICK MOUNTED MUTABLE TAMBOURINE

BACKGROUND OF THE INVENTION

The present invention generally relates to a drumstick mounted mutable tambourine. More specifically, the invention relates to the present invention relates to a device that mutes and un-mutes a drumstick tambourine.

Attempts have been made to combine percussive instruments to extend the range of effects that a single percussionist can achieve, including providing a combination tambourine and drumstick.

However, there is a need for an instrument that combines a drumstick and a tambourine, but that is mutable.

SUMMARY OF THE INVENTION

In one aspect of the present invention, a drumstick mountable mutable tambourine comprises a body mountable to the drumstick; a block attached to the body on which one or more mutable sound making devices are mountable; and a muting device capable of actuation for muting the mutable sound making devices.

In another aspect, a drumstick mountable mutable tambourine, comprises a tubular body mountable to the round drumstick; a block attached radially to the body on which one or more mutable sound making devices are mountable; and a muting device capable of actuation for muting the mutable sound making devices.

These and other features, aspects and advantages of the present invention will become better understood with reference to the following drawings, description and claims;

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Figure 1:
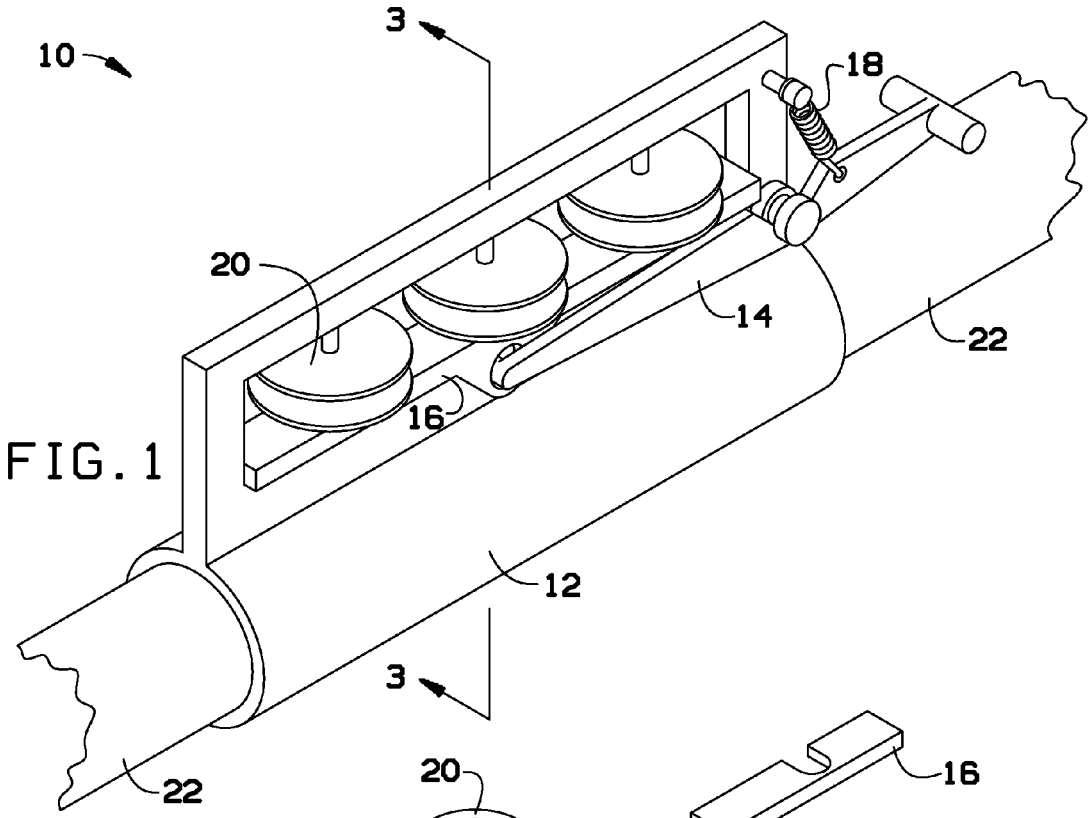
FIG. 1 is a perspective view of drumstick mounted mutable tambourine shown in use according to one embodiment.

Broadly, embodiments of the present invention generally provide a drumstick mounted mutable tambourine. With reference to FIG. 1. a perspective view of a drumstick mounted mutable tambourine 10 is shown in use according to one embodiment. The tambourine 10 includes a body 12, which, in one embodiment, is tubular with a hollowed out block formed or attached therewith, so as to fit around a drumstick 22 with a round cross section.

The body 12 may support a block 16 under one or more cymbals 20 or other devices that may make sounds or jingle mounted within the hollowed rectangle portion of the body 12. The block 16 may be able to be moved into a position that dampens the cymbals 20 by means of a lever 14. The lever 14 may be biased by a spring 18 so the block 16 may be positioned in a non-dampened position. In this way, the tambourine 10 may normally be active so as to provide sound when shaken, and the user may press down on leaver as needed to mute the tambourine 16.

Figure 2:
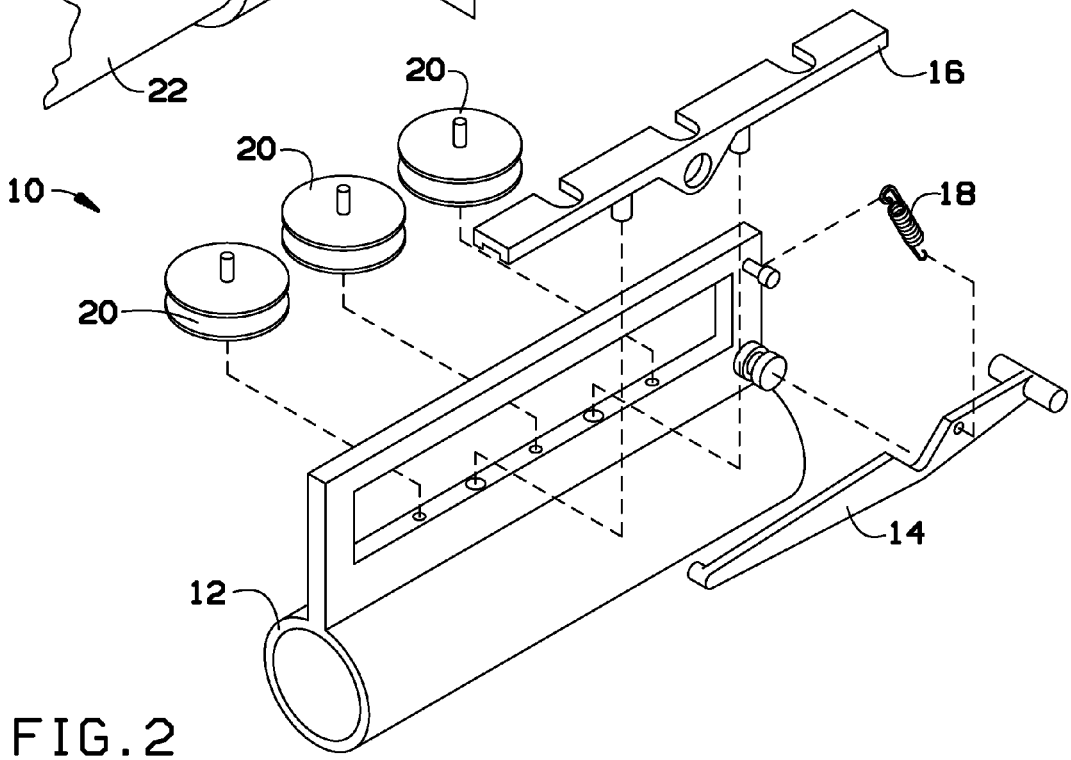
FIG. 2 is an exploded view of the drumstick mounted mutable tambourine according to the embodiment of FIG. 1.

With reference to FIG. 2, an exploded view of the drumstick mounted mutable tambourine 10 according to the embodiment of FIG. 1 is shown. The hollowed rectangular portion of the body 12 may comprise a hollowed out rectangle of solid material in which three sets of cymbals 20 are placed. The block 16 may be placed across the bottom of the inside of the rectangular portion of the body 12 that may be pushed up by the thumb actuated lever 14 to mute the cymbals 20.

Figure 3:
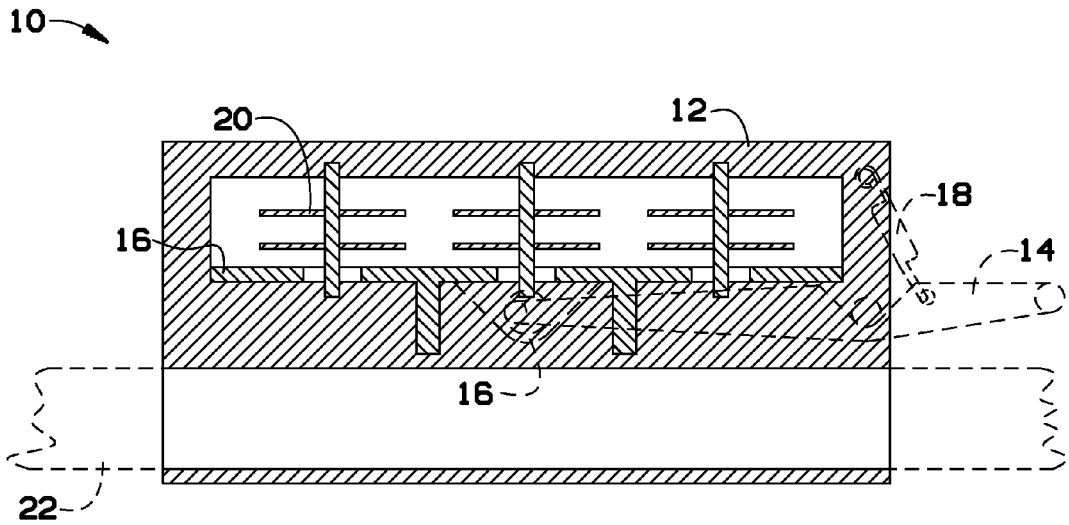
FIG. 3 is a sectional view of the drumstick mounted mutable tambourine along line 3-3 in FIG. 1.

With reference to FIG. 3, a sectional view of the drumstick mounted mutable tambourine 10 along line 3-3 in FIG. 1 is shown. In FIG. 3, the lever 14 and block 16 are shown as when the cymbals 20 are in the non-muted position.

Figure 4:
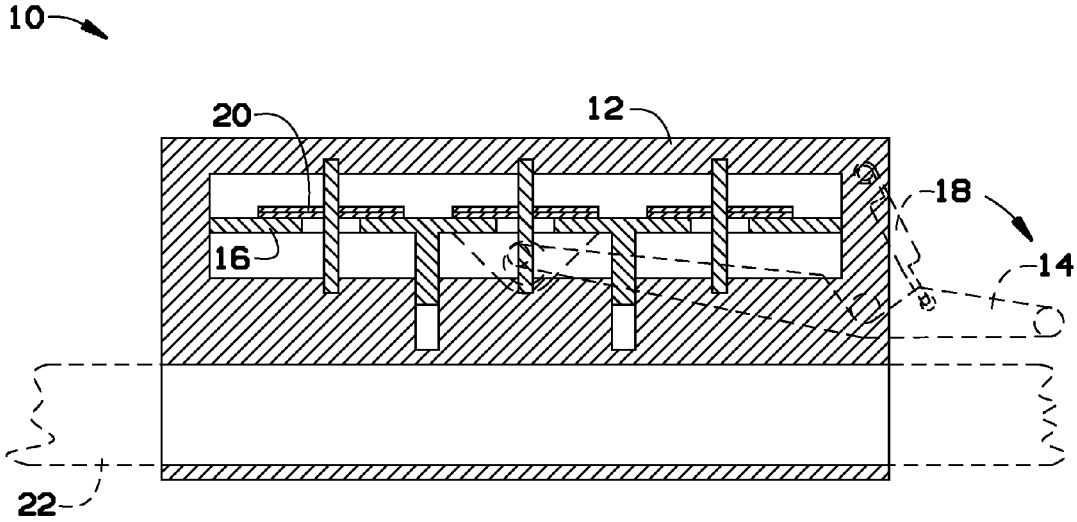
FIG. 4 is another sectional view of the drumstick mounted mutable tambourine of FIG. 1.

With reference to FIG. 4, another sectional view of the drumstick mounted mutable tambourine 10 along line 3-3 in FIG. 1 is shown. In FIG. 4, the lever 14 and block 16 are shown as when the cymbals 20 are in the muted position.

As those skilled in the art would recognize, other means may be used to mute cymbals 20, including by applying downward pressure to cymbals 20 instead of upward pressure. In any instance, the user may place the tambourine 20 on a drumstick 22 and play the drums as the user normally would, and press down on the mute lever 14 as needed to mute or un-mute tambourine 10.

It should be understood, of course, that the foregoing relates to exemplary embodiments of the invention and that modifications may be made without departing from the spirit and scope of the invention as set forth in the following claims.

The invention claimed is:

1. A drumstick mountable mutable tambourine, comprising:

a body mountable to the drumstick;

a block attached to the body on which one or more mutable sound making devices are mountable; and a muting device capable of actuation for muting the mutable sound making devices; and a centrally mounted pivotal receptacle on the muting device; and an actuation arm with a knob pivotally engaged in the pivotal receptacle, wherein the arm moves so the muting device pivots to evenly engage with the sound making devices.

2. The drumstick mountable mutable tambourine of claim 1, wherein the sound making devices comprise one or more cymbals.

3. The drumstick mountable mutable tambourine of claim 2, wherein actuation device comprises a lever arm.

4. The drumstick mountable mutable tambourine of claim 3, wherein actuation device further comprises a block that is movable by the lever to mute the cymbals.

5. The drumstick mountable mutable tambourine of claim 2, wherein the sound making device consists of three sets of cymbals with an extra metal ring in the middle of each set of cymbals to add more sound and fidelity, eliminating the need for more cymbals.

6. The drumstick mountable mutable tambourine of claim 3, wherein actuation lever utilizes a double pivoting arm.

7. The drumstick mountable mutable tambourine of claim 4, wherein the actuation device further utilizes a block that transports cymbals evenly to muting mode with the use of an arm.

8. A drumstick mountable mutable tambourine, comprising:

a tubular body mountable to the round drumstick;

a block attached radially to the body on which one or more mutable sound making devices are mountable in a single row along the length of the block;

the block comprising a hollowed, rectangular portion, forming a base and an encircling beam frame and a single row of mounts in each of the base and beam for mounting the sets of one or sound making devices; and a muting device capable of actuation for muting the mutable sound making devices.

9. The drumstick mountable mutable tambourine of claim 8, wherein the sound making devices comprise one or more cymbals.

10. The drumstick mountable mutable tambourine of claim 9, wherein actuation device comprises a lever arm.

11. The drumstick mountable mutable tambourine of claim 10, wherein actuation device further comprises a block that is movable by the lever to mute the cymbals.

12. The drumstick mountable mutable tambourine of claim 9, wherein the sound elements entails three sets of cymbals with an additional metal ring between cymbals.

13. The drumstick mountable mutable tambourine of claim 9, wherein actuation mechanism further transports the three sets of cymbals evenly up three posts by means of the muting block by the use of arm.

14. The drumstick mountable mutable tambourine of claim 13, further comprising a centrally mounted pivotal receptacle on the muting block; and the lever arm comprises a knob pivotally engaged in the pivotal receptacle.

15. The drumstick mountable mutable tambourine of claim 14, further comprising a pivot knob and a spring knob;

a spring;

a notch along the length of the lever arm, a spring mount hole, and a lever handle;

where the lever arm notch pivots about the pivot knob while the spring is mounted between the pivot knob and spring mount hole and holds the lever in place on the pivot knob while biasing the lever in the non-muting position, and when the mutable tambourine is mounted on a drumstick and being used for playing, a user can press the handle so the arm pivots and the muting block pivots with respect to the arm providing a motion to evenly engage the muting block with the cymbals.

16. The drumstick mountable mutable tambourine of claim 13, where the cymbals are pressed together when muted and are held loosely when not muted, such that a user of the drumstick can produce a percussive sound by striking a drum and a simultaneous tambourine sound from the cymbals.

* * * * *